US007571517B2

(12) United States Patent
Smith et al.

(10) Patent No.: US 7,571,517 B2
(45) Date of Patent: Aug. 11, 2009

(54) MULTI-FUNCTION TOOL HANDLE

(75) Inventors: Robin Edward Smith, Stanley, NC (US); Brandon C. Hoover, Cornelius, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 555 days.

(21) Appl. No.: 11/160,564

(22) Filed: Jun. 29, 2005

(65) Prior Publication Data

US 2007/0000097 A1 Jan. 4, 2007

(51) Int. Cl.
*B25G 1/10* (2006.01)

(52) U.S. Cl. ..... 16/436; 16/422; 16/426; 81/177.2; 81/177.6; 81/177.7; 81/177.8

(58) Field of Classification Search ..... 16/421, 16/430, 431, 436, 900, 406, 422, 426, 110.1; 81/177.1, 177.4, 177.6, 177.7, 450, 489, 81/490

See application file for complete search history.

(56) References Cited

U.S. PATENT DOCUMENTS

| | | | | |
|---|---|---|---|---|
| RE10,145 | E | 7/1882 | Chantrell | |
| 428,662 | A | 5/1890 | Bartlett | |
| 839,477 | A | 12/1906 | Heller | |
| 1,175,902 | A * | 3/1916 | Peterson | 81/436 |
| 1,530,905 | A | 3/1925 | Nance | |
| 1,531,732 | A | 3/1925 | Burkholder | |
| 1,582,889 | A | 5/1926 | Abbiuso | |
| 1,597,747 | A | 8/1926 | Wermes | |
| 2,482,348 | A | 9/1949 | Land | |
| 2,726,695 | A | 12/1955 | Malm | |
| 3,672,419 | A | 6/1972 | Fischer | |
| 3,773,094 | A | 11/1973 | Kuenzel | |
| 4,542,667 | A | 9/1985 | Jang | |
| 4,787,276 | A | 11/1988 | Condon | |
| 4,934,221 | A | 6/1990 | Hsiao | |
| 5,069,091 | A | 12/1991 | Bramsiepe et al. | |
| 5,101,696 | A | 4/1992 | Neff | |
| 5,142,953 | A | 9/1992 | Lin | |
| 5,228,363 | A | 7/1993 | Corona et al. | |
| 5,421,225 | A * | 6/1995 | Chen | 81/490 |
| 5,873,147 | A * | 2/1999 | Hintz | 16/426 |
| 6,029,549 | A | 2/2000 | Baker | |
| 6,095,018 | A * | 8/2000 | Schuster | 81/177.5 |
| 6,230,593 | B1 | 5/2001 | Hsieh | |
| 6,379,020 | B1 | 4/2002 | Lewis et al. | |

(Continued)

*Primary Examiner*—Victor Batson
*Assistant Examiner*—Emily M Morgan
(74) *Attorney, Agent, or Firm*—Dennis J. Williamson; Matthew W. Witsil; Moore & Van Allen PLLC

(57) ABSTRACT

The tool handle of the invention includes a shank connected via a ratcheting mechanism to a male square drive. A pair of handle wings are pivotally connected to the shank at a transverse pivot hinge such that the handle wings can be changed between a screwdriver-type configuration, an L-shape configuration, a T-shape configuration or other intermediate configurations. When the handle wings are in the fully open position, the handle wings bear against the shank to create a mechanism for transferring power between the handle wings and the tool shank without the need for a separate lock. A quick change adapter having a female drive can be connected to the male square drive such that the tool handle can be used with a wide variety of tools including taps and extractors, sockets, screwdriver bits and the like.

17 Claims, 7 Drawing Sheets

U.S. PATENT DOCUMENTS 6,397,709 B1 * 6/2002 Wall ..... 81/440
6,401,301 B1 * 6/2002 Hung ..... 16/430
6,401,576 B1 6/2002 Wu
6,431,034 B1 * 8/2002 Chen ..... 81/177.4
6,564,680 B1 * 5/2003 Rinner et al. ..... 81/177.5
6,877,186 B2 * 4/2005 Shiao ..... 16/111.1
2003/0037643 A1 2/2003 Hess
2004/0163501 A1 8/2004 Chen
2006/0143858 A1 * 7/2006 Carr ..... 16/110.1

* cited by examiner

MULTI-FUNCTION TOOL HANDLE

BACKGROUND

The invention relates generally to a tool handle for holding rotary tools and more particularly to an improved multi-function, reconfigurable tool handle for holding taps and extractors and other fastener tools such as screwdriver bits, sockets and the like.

Taps and extractors are rotary tools for making threaded holes and removing stripped fasteners, respectively. In order to generate sufficient torque, taps and extractors are typically used with a handle that can be rotated by hand. The taps and extractors are releasably connected to the handle such that the handle can be used with different taps and extractors. Typically the taps and extractors include male connector portions that engage a female receptacle formed on the handle.

Existing tap and extractor handles are specifically designed to engage taps and extractors such that they are not useable with other fastener tools such as sockets and screwdriver bits. Moreover, known handles do not offer sufficient flexibility in the configuration of the handle for different applications. Known handles also do not provide a reconfigurable design that is easy to use yet can adequately transfer high torque.

A multi-purpose tool handle that can be connected to a wide variety of tools and that is easily reconfigurable for different applications is desired.

SUMMARY OF THE INVENTION

The tool handle of the invention includes a shank connected via a ratcheting mechanism to a male square drive. A pair of handle wings are pivotally connected to the shank at a transverse pivot hinge such that the handle wings can be changed between a screwdriver-type configuration, an L-shape configuration, a T-shape configuration and other configurations. When the handle wings are in the fully open position, the handle wings bear against the shank to create a mechanism for transferring power between the handle wings and the tool shank without the need for a separate lock. A quick change adapter having a female drive can be connected to the male square drive such that the tool handle can be used with a wide variety of tools including taps and extractors, sockets, screwdriver bits and the like.

DETAILED DESCRIPTION OF EMBODIMENTS OF THE INVENTION

Figure 1:
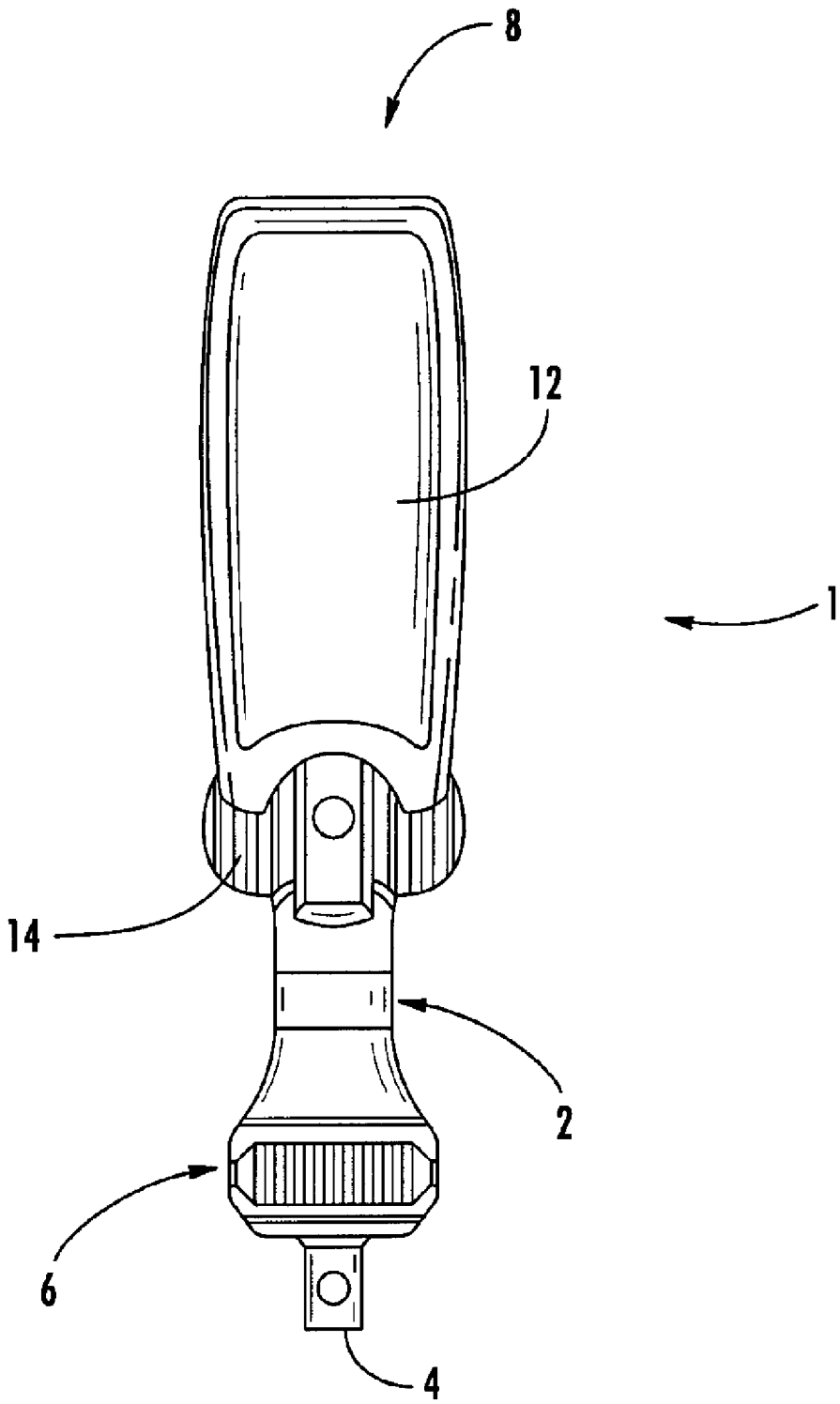
FIG. 1 is a front elevation view of one embodiment of the tool handle of the invention.
Figure 2:
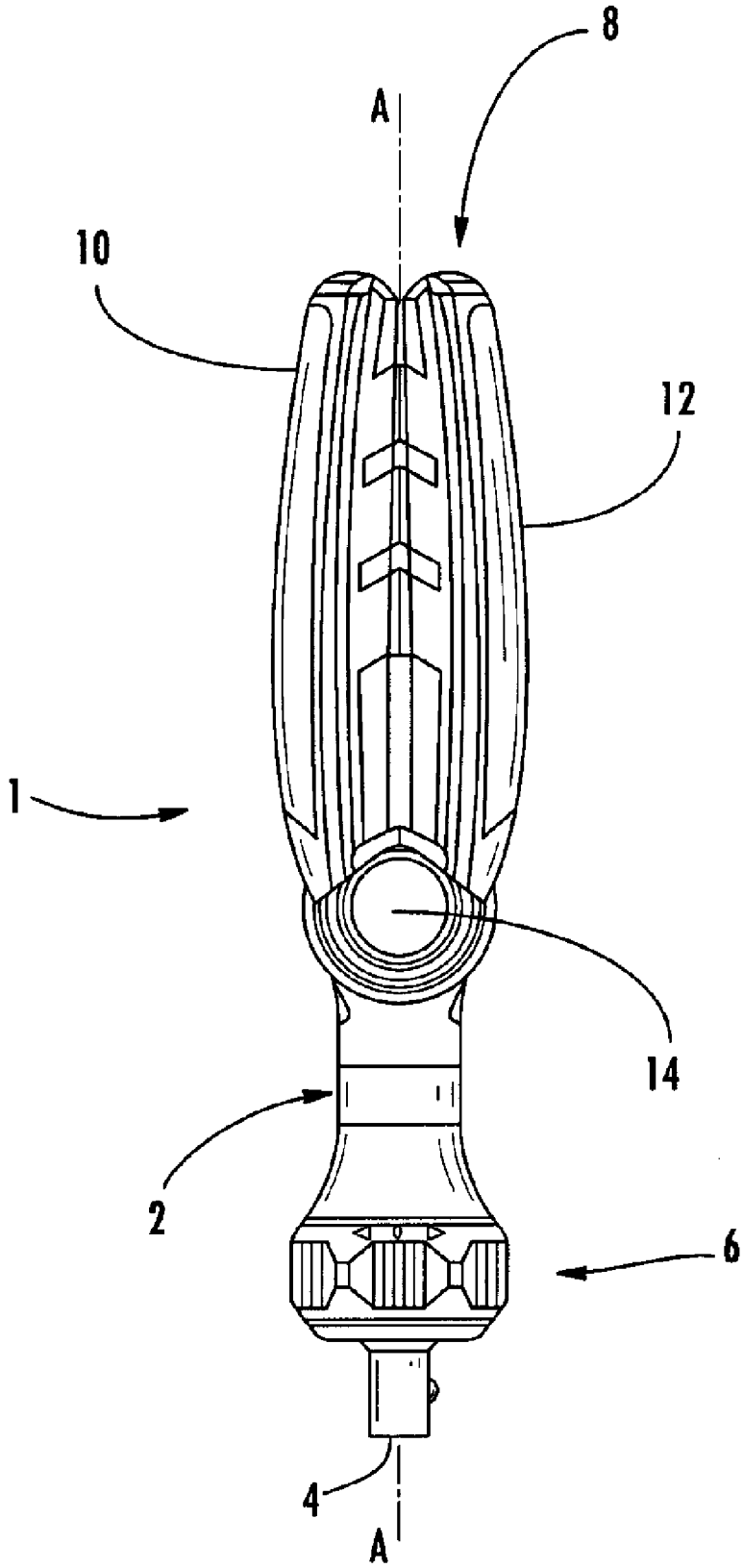
FIG. 2 is a side elevation view of one embodiment of the tool handle of the invention in a first configuration.
Figure 3:
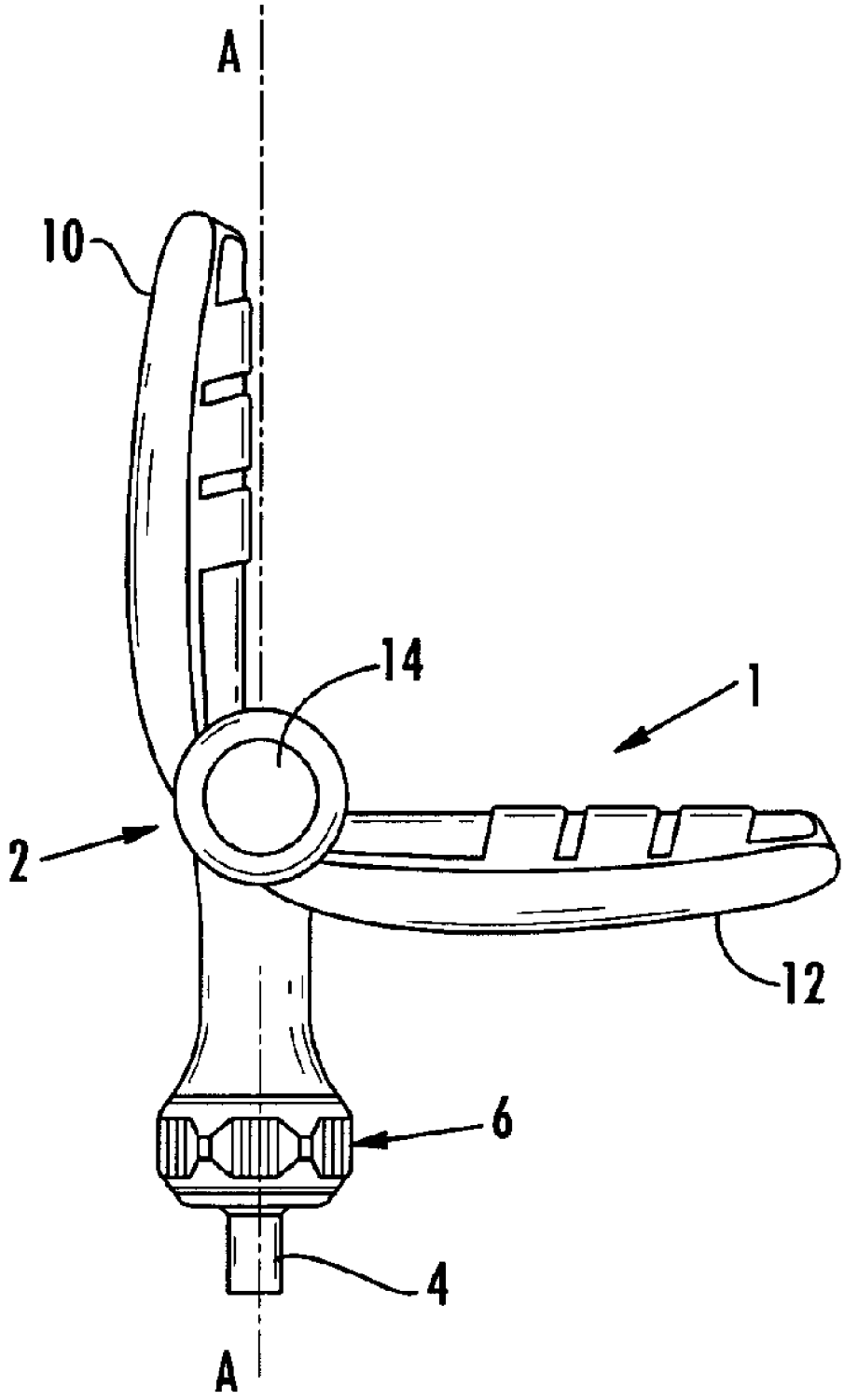
FIG. 3 is a side elevation view of one embodiment of the tool handle of the invention in a second configuration.
Figure 4:
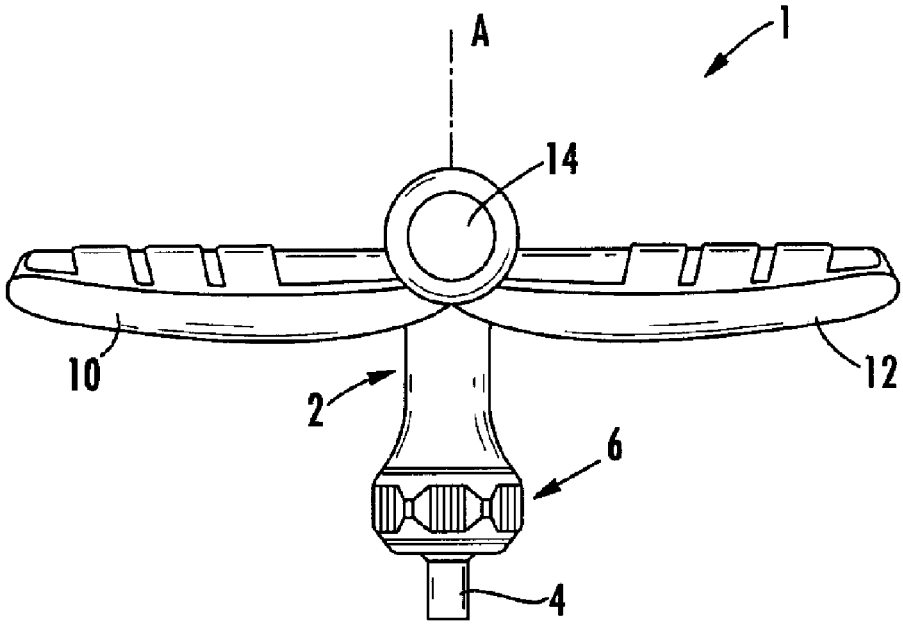
FIG. 4 is a side elevation view of one embodiment of the tool handle of the invention in a third configuration.
Figure 5:
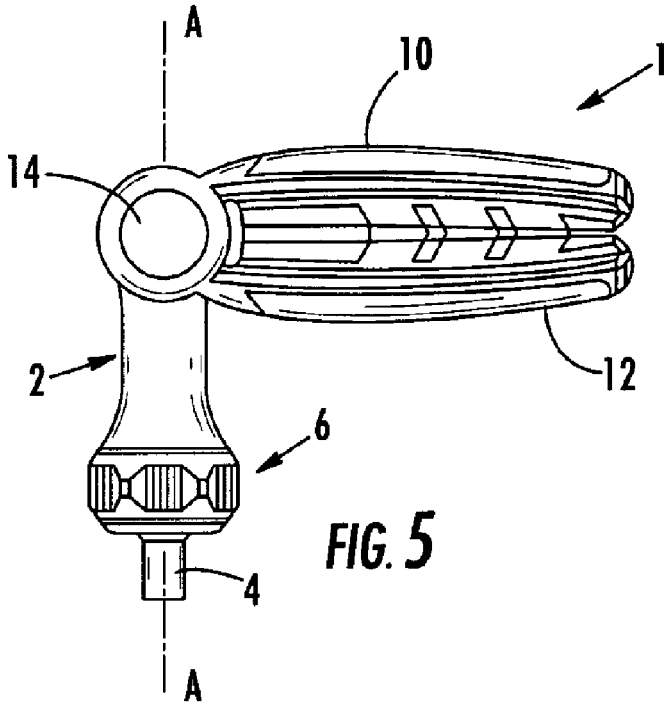
FIG. 5 is a side elevation view of one embodiment of the tool handle of the invention in a fourth configuration.

Referring more particularly to FIGS. 1 and 2, the tool handle is shown generally at 1 and consists of a shank 2 that supports a male square tool drive 4 via ratcheting mechanism 6. A handle 8 comprising a pair of handle wings or portions 10 and 12 is pivotally connected to shank 2 at pivot hinge 14. The tool handle of the invention can adopt the "screwdriver" handle configuration shown in FIGS. 1 and 2. In this configuration the handle wings 10 and 12 are in the closed position and are disposed substantially parallel to the longitudinal axis A-A of the shank 2 with the distal ends of the handle wings extending away from the square tool drive 4. The tool handle 1 can also adopt the L-shaped configuration of FIG. 3 where one handle wing 10 is in the closed position and the other handle wing 12 is in the fully open position where it extends substantially perpendicular to the longitudinal axis A-A. The tool handle 1 can also adopt the T-shaped configuration of FIG. 4 where both handle wings 10 and 12 are extended to the fully open position and are substantially perpendicular to longitudinal axis A-A. The tool handle 1 can also adopt the folded over configuration of FIG. 5 where handle wing 12 is in the open position and handle wing 10 is on the same side of longitudinal axis A-A as handle wing 12 with handle wing 10 abutting handle wing 12. The handle wings 10 and 12 could also adopt other intermediate configurations.

Figure 6:
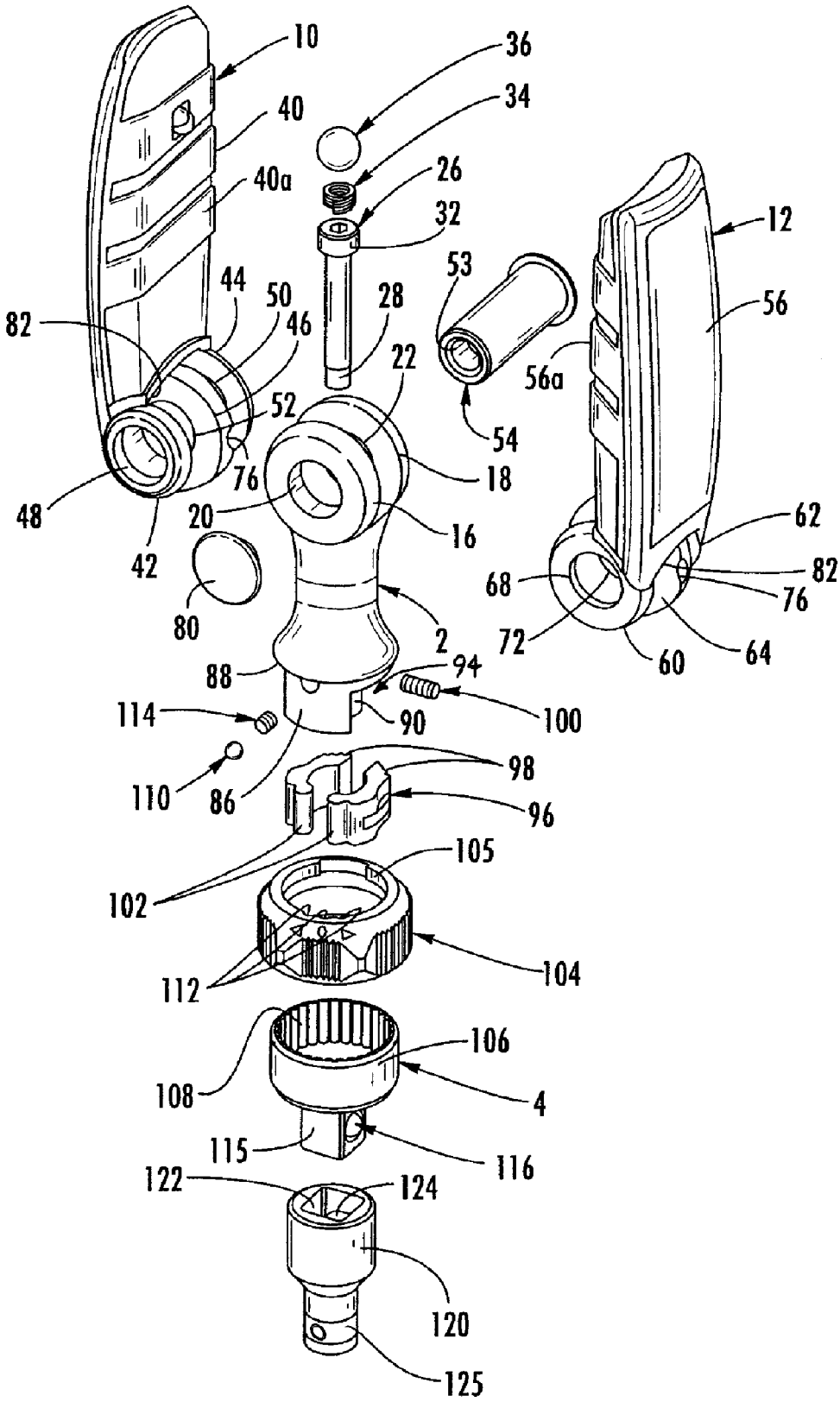
FIG. 6 is an exploded perspective view of one embodiment of the tool handle of the invention.

Referring more particularly to FIG. 6, shank 2 has an upper portion terminating in extending flanges 16 and 18 that define apertures 20 and 22, respectively. The flanges 16 and 18 are spaced from one another to define a gap therebetween for receiving mating portions of handle wings 10 and 12 as will be described. A bore (not shown) extends along the longitudinal axis of shank portion 2 to receive a shoulder screw 26. Shoulder screw 26 has screwthreads 28 that engage mating internal screwthreads formed on the interior of tool drive 4. Shoulder screw 26 terminates in a head 32 that supports compression spring 34. Compression spring 34 in turn supports ball 36 and urges ball 36 into engagement with the handle wings 10 and 12 to snap lock the handle wings in the desired position as will hereinafter be described. Shoulder screw 26 connects the tool drive 4 to shank 2 but allows the square drive to rotate relative to the shank.

Handle wing 10 includes a handle portion 40 that terminates in outer flanges 42 and 44 and inner flange 46 that define apertures 48, 50 and 52, respectively. The apertures are coaxially aligned with one another and are dimensioned to closely but rotatably receive hinge pin 54. Handle wing 12 may be identical to handle wing 10 and includes a handle portion 56 that terminates in outer flanges 60 and 62 and inner flange 64. Flanges 60 and 62 define apertures 68 and 72, respectively. Flange 62 also defines an aperture (not shown) similar to aperture 48 defined by flange 42. The apertures formed on flanges 60, 62 and 64 are dimensioned to closely but rotatably receive hinge pin 54 and are coaxially aligned with one another and with apertures 48, 50 and 52 of handle wing 10 in the assembled tool handle.

These components can be made by metal injection molding, or die cast zinc-aluminum alloy fabrications. A secondary material such as TPR can be overmolded on the handles to improve the grip and comfort of the tool.

Inner flange 46 of handle wing 10 and inner flange 64 of handle wing 12 are dimensioned to closely but rotatably fit between flanges 16 and 18 of shank 10. Inner flange 46 and inner flange 64 each include a flat face that abut one another when the flanges are located between the flanges 16 and 18. Moreover, each of inner flanges 46 and 64 include detents 76 spaced about the periphery thereof such that the detents on inner flange 46 may be aligned with the detents on inner flange 64 to define recesses for receiving ball 36. The detents are spaced about the periphery of the flanges 46 and 64 so that they are aligned with ball 36 when the wing handles 10 and 12 are in any of the desired configurations described with reference to FIGS. 1-4 or any other desired handle configuration.

Outer flange 44 is spaced from inner flange 46 so as to be positioned outside of and in abutting contact with flange 18. Outer flange 62 is spaced from flange 64 so as to be positioned outside of and in abutting contact with flange 44. Outer flange 60 is spaced from inner flange 64 so as to be positioned outside of and in abutting contact with flange 16. Outer flange 42 is spaced from inner flange 46 so as to be positioned outside of and in abutting contact with outer flange 60. Hinge pin 54 passes through the apertures defined by the interdigitated flanges to complete the pivot hinge 14. In this manner the flanges of the handle wings 10 and 12 and the shank 2 are interdigitated to create a strong connection at pivot hinge 14 to maximize the amount of torque that can be transferred through the wing handles 10 and 12 to the shank 2. In one embodiment the flanges are tapered from the inner flange to the outermost flange to create a streamlined profile as best shown in FIG. 1.

A hinge pin cover 80 is friction fit into aperture 53 of hinge pin 54 to lock the hinge pin in place. The handle wings 10 and 12 are free to rotate relative to one another and relative to the shank 2 such that the handle wings can be rotated independently or together as a unit. The engagement of ball 36 with detents 76 locks the handles in the desired position. It is to be understood that the engagement of ball 36 and detents 76 can be overcome by manually applying a rotational force to either of the handle wings sufficient to depress spring 34 and release ball 36 from detents 76. The spring is preferably selected such that this force can be overcome by the force applied by a typical user with one hand. In this manner the tool handle can be reconfigured very easily by the user.

The inner face 40*a* of handle wing 10 is positioned substantially on the centerline of the apertures formed on flanges 42, 44 and 46. Likewise, the inner face 56*a* of handle wing 12 is positioned substantially on the centerline of the apertures formed on flanges 60, 62 and 64. As a result, when the handles are in the closed position of FIG. 1 the handle wings are parallel to one another and to the longitudinal axis A-A and are equally offset on opposite sides of longitudinal axis A-A. The hinge is located close to the drive end 4 such that the user's hand is located closer to the workpiece. The placement of the hinge also creates a lower profile when the handle wings are in the T-shape configuration to provide better access when space is limited.

Because it may be necessary to exert a significant force toward square tool drive 4 when using the tool handle, the handle wings 10 and 12 are designed such that a portion 82 of the handle wings 10 and 12 abuts shank 2 when the handle wings are in the fully opened position. Portion 82 is the area of the handle wings between and adjacent to the flanges that contacts shank 2. In one embodiment portion 82 may be configured to conform to the outer shape of shank 2. In this manner, forces exerted on the handle wings 10 and 12 are transferred by direct load bearing contact from the handle wings to shank 2. This arrangement provides strong support for the handle wings and an effective force transference between the handle wings and the shank without the use of additional locking or load transferring mechanisms.

The opposite end of shank 2 is formed with a first extension 86 that meets with the shank to create a shoulder 88. A second semi-circular extension 90 extends from the base of the first extension to create a semi-circular recessed area 94 (the recessed area 94 is identical to area identified by reference numeral 294 in FIG. 7). Positioned in the recessed area 94 are a pair of pawls 96 that have gear teeth 98 that engage with mating gear teeth on square drive 4 as will hereinafter be described. A ratchet spring 100 is disposed between the free ends of pawls 96 to exert a force on the pawls tending to urge the ends of pawls away from one another. The pawls are formed with pivots 102 that fit into mating cavities formed in recessed area 94 (a cavity is also shown at 303 in FIG. 7). The pawls 96 rotate about pivots 102 under the force applied by spring 100. A ratchet ring 104 fits over pawls 96, abuts shoulder 88 and rotatably receives the annular portion 106 of square drive. The ratchet ring 104 includes a camming surface 105 that can move pawls 96 against spring 100 and out of engagement with gear teeth 108. The ratchet ring can be moved between one of three positions. In the first position both pawls 96 are engaged with the gear teeth 108 of annular portion 106 such that the square drive is fixed in position relative to the shank 2. In the second position one of the pawls 96 engages the gear teeth 108 of square drive such that the square drive can rotate relative to the shank in a first direction but is fixed relative to shank portion in the opposite, second direction to effect a ratcheting movement of square drive as will be understood. In the third position the other pawl 96 engages the gear teeth 108 such that the square drive can rotate relative to the shank portion in the second direction but is fixed relative to the shank portion in the first direction. It will be understood that in the second position the ratchet operation will tighten a fastener and in the third position the ratchet operation will loosen the fastener. A ratchet detent ball 110 is biased into engagement with recesses 112 by ratchet detent spring 114 to hold the ratchet ring 104 in the desired position.

The square tool drive 4 includes a ball detent 116 on the square drive connector 115 to releasably engage a tool having a female connector portion such as a socket. In one embodiment, square drive connector 115 is a ⅜ inch male connector that will fit most standard ⅜ inch drive sockets. The square drive also can be connected to a quick change adapter 120 that includes a cavity 122 for releasably receiving square drive connector 115. Cavity 122 includes a recess 124 for receiving ball detent 116 to lock the adapter on the square drive. A chuck 125 for connecting the quick change adapter 120 to a tap, extractor or other tool having a male connector portion is provided on the distal end of the quick change adapter. The ratchet, square drive and adapter may be made of powdered metal or cold or hot forged metal.

Figure 7:
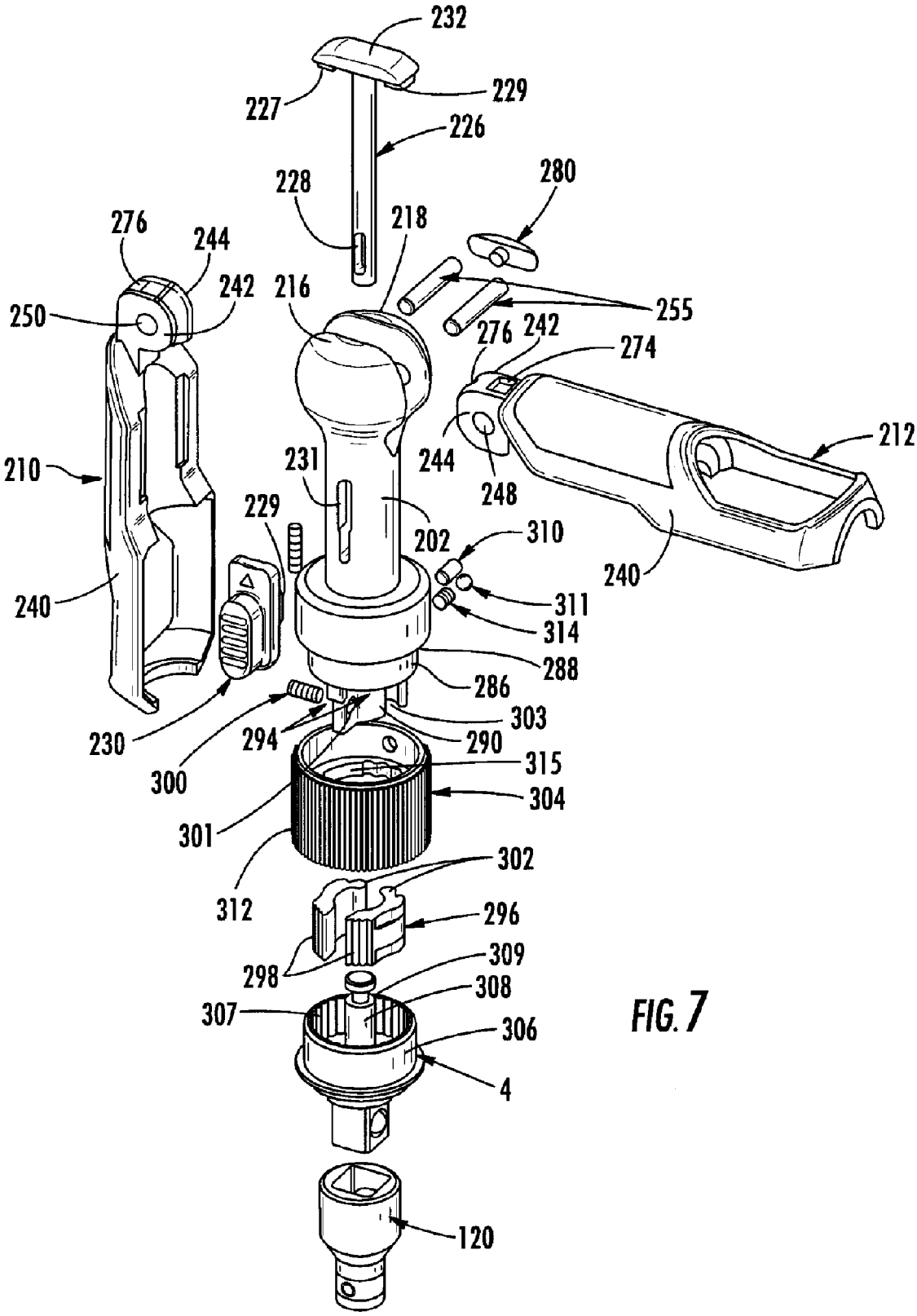
FIG. 7 is an exploded perspective view of an alternate embodiment of the tool handle of the invention.

Referring more particularly to FIG. 7 an alternative embodiment of the tool handle of the invention is shown having a shank 202 terminating in an upper portion having extending flanges 216 and 218 spaced from one another to define a gap therebetween for receiving mating portions of handle wings 210 and 212 as will be described. A bore (not shown) extends along the longitudinal axis of shank 202 to receive a latch pin 226. Latch pin 226 is formed with a slot 228 that is engaged by a finger 229 on release button 230 that extends through a slot 231 formed in shank 202. Latch pin 226 terminates in a head 232 that includes protrusions 227 and 229 that engage the ends of handle wings 210 and 212 as will hereinafter be described.

Handle wings 210 and 212 are identical and include a handle portion 240 that terminates in flanges 242 and 244 and that define apertures 248 and 250, respectively. The apertures are coaxially aligned with one another and are dimensioned to closely but rotatably receive hinge pins 255. Hinge pins 255 are inserted through the axially aligned apertures to create a pivot hinge connection between the handle wings 210 and 212 and the shank 202. A hinge pin cover 280 is friction fit into an aperture (not shown) on shank 202 to lock the hinge pins 255 in place. The handle wings 210 and 212 are free to rotate relative to one another and relative to the shank 202 such that the handle wings can be rotated independently.

These components can be made by metal injection molding or die cast zinc-aluminum alloy fabrications. A secondary material such as TPR can be overmolded on the handles to improve the grip and comfort of the tool.

The flanges 242 and 244 of handles 210 and 212 are dimensioned to closely but movably fit between flanges 216 and 218 of shank 202. Moreover, handle wings 210 and 212 include apertures 274 and 276 for receiving the protrusions 227 and 229 extending from latch pin head 232. Release button 230 is used to move latch pin 226 into and out of engagement with the apertures on handles 210 and 212. When the latch pin is engaged with the apertures handles 210 and 212 are prevented from moving relative to the shank 202, when the latch pin is removed from the apertures 274 and/or 276, the handle wings can be pivoted between the closed position shown by handle wing 210 and the open position shown by handle wing 212.

The opposite end of shank 202 is formed with a first extension 286 that meets with the shank to create a shoulder 288. A second semi-circular extension 290 having a smaller diameter than the first extension 286 extends from the base of the first extension to create a semi-circular recessed area 294. Positioned in the recessed areas 294 are a pair of pawls 296 that have gear teeth 298 that engage with mating gear teeth 307 on square drive 4 as will hereinafter be described. A ratchet spring 300 is disposed in aperture 301 between the free ends of pawls 296 to exert a force on the pawls tending to urge the ends of pawls away from one another. The pawls are formed with pivots 302 that fit into mating cavities 303 formed in recessed area 294 such that the pawls 296 rotate about pivots 302 in cavities 303. A ratchet ring 304 fits over pawls 296 and rotatably receives the annular portion 306 of square drive. A shaft 308 extends from square drive into a longitudinally extending bore (not shown) formed in shank 202. The shaft has an annular groove 309 formed therein. A pin 310 is inserted through a transverse bore formed in shank 202 such that the pin engages groove 309 to retain the square drive in the shank but allow it to rotate relative to the shank. A ratchet detent ball 311 is biased into engagement with recesses 312 by ratchet detent spring 314 to hold the ratchet ring in the desired position. The ratchet ring includes a camming surface 315 can be rotated between one of three positions as described with reference to the embodiment shown in FIG. 6 to effect the ratcheting movement of square connector. A quick change adapter 120 such as described with reference to FIG. 6 may be used with the square connector.

Figure 8:
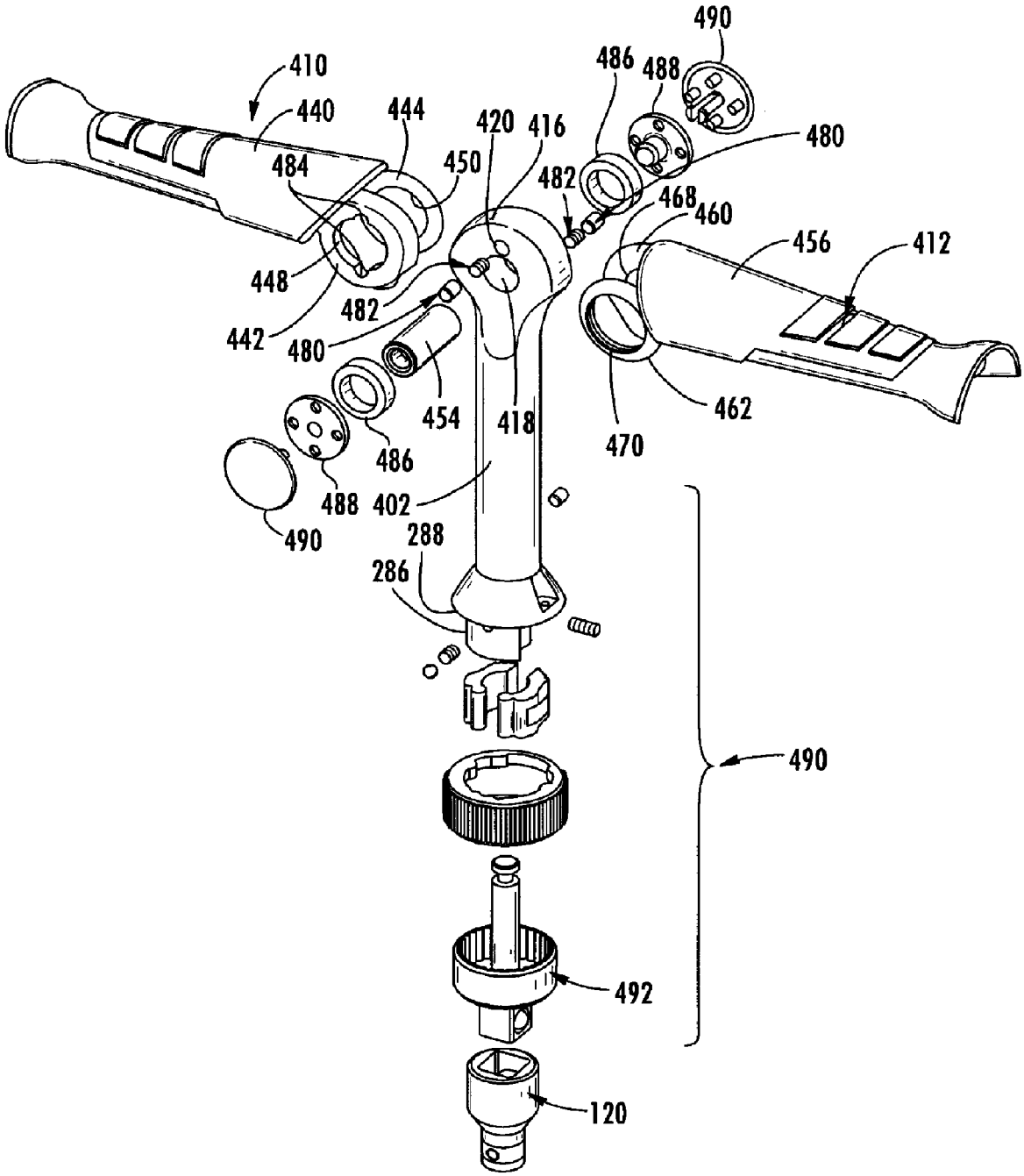
FIG. 8 is an exploded perspective view of another alternate embodiment of the tool handle of the invention.

Referring more particularly to FIG. 8 an alternative embodiment of the tool handle of the invention is shown having a shank 402 terminating in an upper portion having a flange 416 defining a hinge pivot aperture 418. A spring aperture 420 is provided on each side of flange 416 for receiving a springs 482 and locking pins 480. It will be appreciated that while only one spring aperture is visible in FIG. 8, a second aperture is provided on the opposite side of flange 416.

Handle wing 410 includes a handle portion 440 that terminates in flanges 442 and 444 and that define apertures 448 and 450, respectively. The apertures are coaxially aligned with one another and are dimensioned to closely but rotatably receive hinge pin 454. Likewise handle wing 412 may be identical to handle wing 410 and includes a handle portion 456 that terminates in flanges 460 and 462 that define apertures 468 and 470, respectively. The apertures are coaxially aligned with one another and are dimensioned to closely but rotatably receive hinge pin 454. The flanges 442 and 460 are dimensioned to closely but movably fit between over flange 416. Flanges 444 and 462 are dimensioned to closely but movably fit over flanges 460 and 442, respectively. Hinge pin 454 is inserted through the axially aligned apertures to create a pivot hinge connection between the handle wings 410 and 412 and the shank 402, respectively.

These components can be made by metal injection molding or die cast zinc-aluminum alloy fabrications. A secondary material such as TPR can be overmolded on the handles to improve the grip and comfort of the tool.

The locking mechanism for locking the handles in the desired position is the same on both sides of the shank, for explanatory purposes only one side will be described. The locking mechanism comprises locking pin 480 slidably received in bore 420 and biased so as to extend out of the bore 420 by spring 482. The pin is located on flange 416 such that in the normal locked position it can engage detents 484 formed about the periphery of aperture 448 in flange 442. A release ring 486 is slidably positioned on pin 454 such that it contacts pin 480. A pin retainer 488 covers the release ring and a release button 490 is connected to hinge pin 455. To release the locking mechanism, release button 490 is depressed causing release ring 486 to depress pin 480 until the pin no longer engages detent 484. The handle can then be rotated. When release button is released, spring 482 extends pin 480 back into engagement with detents 484. Because the locking mechanism may be formed on both sides of flange 416, a user will typically squeeze both release buttons simultaneously to release both handles at the same time.

A ratchet assembly 490 as previously described with reference to FIG. 7 is included to connect shank 402 to square tool drive 492. A quick change adapter 120 such as described with reference to FIG. 6 may be used with the square tool drive 492.

In operation the tool handle is connected to a tool either by direct connection to the square tool drive or via the quick change adapter. The tool handle can then be reconfigured to the desired grip configuration based on the amount of torque required and the space available to access the workpiece. The ergonomic design also provides an advantage for people with disabilities such as arthritis. By providing the opposing wings, it is possible to use the strength of both hands and arms to turn the tool.

Specific embodiments of an invention are disclosed herein. One of ordinary skill in the computing and financial arts will quickly recognize that the invention has other applications in other environments. Many embodiments are possible. The following claims are in no way intended to limit the scope of the invention to the specific embodiments described above.

What is claimed is:

1. A tool handle for holding a tool operatively connected to one end of the tool handle, the tool handle comprising: a shank supporting a connector; a first handle portion; a second handle portion; said first and second handle portions forming an entire gripping portion of the handle; said first and second handle portions each having an end pivotally connected to the connector and a free end; said first and second handle portions movable between a first position where the first handle portion and second handle portion extend along the longitudinal axis of the shank and away from the shank in the same direction, and a second position where the first and second handle portions extend substantially perpendicularly away from the longitudinal axis in opposite directions, and a third position where the first and second handle portions are on the same side of the longitudinal axis and extend substantially perpendicularly away from the longitudinal axis in the same direction.

2. The tool handle according to claim 1 wherein said first and second handle portions are in load bearing contact with said shank in a first position.

3. The tool handle according to claim 1 wherein the shank is connected to a tool connector via a ratchet.

4. The tool handle according to claim 1 wherein the shank is connected to a tool connector, said tool connector being a male connector.

5. The tool handle according to claim 1 wherein said first and second handle portions are pivotally connected to the shank at a common pivot hinge.

6. The tool handle according to claim 5 said first and second handle portions and said shank including interdigitated portions forming said pivot hinge.

7. The tool handle according to claim 1 further including a locking mechanism for locking the first and second handle portions in a desired position.

8. The tool handle according to claim 7 wherein the locking mechanism includes a ball biased into engagement with the first and second handle portions.

9. The tool handle according to claim 6 wherein the interdigitated portions include at least two portions each of said first handle portion, said second handle portion and said shank.

10. The tool handle according to claim 3 wherein the ratchet is permanently attached to the shank.

11. The tool handle according to claim 9 wherein the interdigitated portions receive a pivot pin.

12. The tool handle according to claim 6 wherein the interdigitated portions include at least three portions each of said first handle portion and said second handle portion.

13. A tool handle for holding a tool operatively connected to one end of the tool handle, the tool handle comprising: a shank supporting a connector; a first handle portion; a second handle portion; said first and second handle portions forming an entire gripping portion of the handle; said first and second handle portions each having an end pivotally connected to the connector and a free end; said first and second handle portions movable between a first position where the first handle portion and second handle portion extend along the longitudinal axis of the shank and away from the shank in the same direction, and a second position where the first and second handle portions extend substantially perpendicularly away from the longitudinal axis in opposite directions, and a third position where the first and second handle portions are on the same side of the longitudinal axis and extend substantially perpendicularly away from the longitudinal axis in the same direction; a screw extends in the shank along the longitudinal axis and rotatably connects the connector to the shank, said screw supports a ball for locking the handles in the first position, second position and third position.

14. A tool handle for holding a tool operatively connected to one end of the tool handle, the tool handle comprising: a shank supporting a connector; a first handle portion; a second handle portion; said first and second handle portions forming an entire gripping portion of the handle; said first and second handle portions each having an end pivotally connected to the connector and a free end; said first and second handle portions movable between a first position where the first handle portion and second handle portion extend along the longitudinal axis of the shank and away from the shank in the same direction, and a second position where the first and second handle portions extend substantially perpendicularly away from the longitudinal axis in opposite directions, and a third position where the first and second handle portions are on the same side of the longitudinal axis and extend substantially perpendicularly away from the longitudinal axis in the same direction; said first handle portion includes a first flange and second handle portion includes a second flange and said shank includes a third flange interdigitated with said first and second flanges to form a pivot hinge where said first flange includes a first plurality of detents and said second flange includes a second plurality of detents where selected ones of the first plurality of detents and second plurality of detents are aligned in the first, second and third positions to define recesses for receiving a single locking member.

15. The tool handle according to claim 1, wherein in all positions between which the first and second handle portions are movable, the first and second handle portions each form an angle of not less than substantially 90 degrees with the longitudinal axis of the shank from the connector towards the end of the tool handle adapted to be connected to the tool.

16. The tool handle according to claim 13, wherein in all positions between which the first and second handle portions are movable, the first and second handle portions each form an angle of not less than substantially 90 degrees with the longitudinal axis of the shank from the connector towards the end of the tool handle adapted to be connected to the tool.

17. The tool handle according to claim 14, wherein in all positions between which the first and second handle portions are movable, the first and second handle portions each form an angle of not less than substantially 90 degrees with the longitudinal axis of the shank from the connector towards the end of the tool handle adapted to be connected to the tool.

* * * * *